United States Patent [19]

Chasteen

[11] Patent Number: 5,071,486

[45] Date of Patent: Dec. 10, 1991

[54] PROCESS FOR REMOVING PROTECTIVE COATINGS AND BONDING LAYERS FROM METAL PARTS

[75] Inventor: Jack W. Chasteen, Kettering, Ohio

[73] Assignee: University of Dayton, Dayton, Ohio

[21] Appl. No.: 559,625

[22] Filed: Jul. 30, 1990

Related U.S. Application Data

[63] Continuation of Ser. No. 135,536, Dec. 18, 1987, abandoned, which is a continuation of Ser. No. 826,718, Feb. 6, 1986, abandoned.

[51] Int. Cl.[5] ..... B08B 5/00; C23G 5/00

[52] U.S. Cl. ..... 134/2; 134/19; 134/31; 134/39

[58] Field of Search ..... 134/2, 19, 30, 31, 39

[56] References Cited

U.S. PATENT DOCUMENTS

| | | | |
|---|---|---|---|
| 4,188,237 | 2/1980 | Chasteen | 134/2 |
| 4,324,594 | 4/1982 | Chasteen | 134/2 |
| 4,328,044 | 5/1982 | Chasteen | 134/2 |
| 4,405,379 | 9/1983 | Chasteen | 134/2 |

FOREIGN PATENT DOCUMENTS

| | | | |
|---|---|---|---|
| 0020935 | 1/1981 | European Pat. Off. | 134/2 |
| 0047067 | 3/1982 | European Pat. Off. | 134/2 |

*Primary Examiner*—Asok Pal

*Attorney, Agent, or Firm*—Killworth, Gottman, Hagan & Schaeff

[57] ABSTRACT

A process for removing protective coatings and/or bonding layers from metal parts, particularly gamma prime hardened nickel base alloy, solid solution superalloy, iron base superalloy, and cobalt base superalloy parts to render them brazable or otherwise bondable. The process uses a C—O—H—F atmosphere as the primary stripping material wherein the atmosphere has a H/O ratio of $10^4$ or greater. The preferred source of the C—O—H—F atmosphere is thermal decomposition of a fluorocarbon resin.

16 Claims, 1 Drawing Sheet

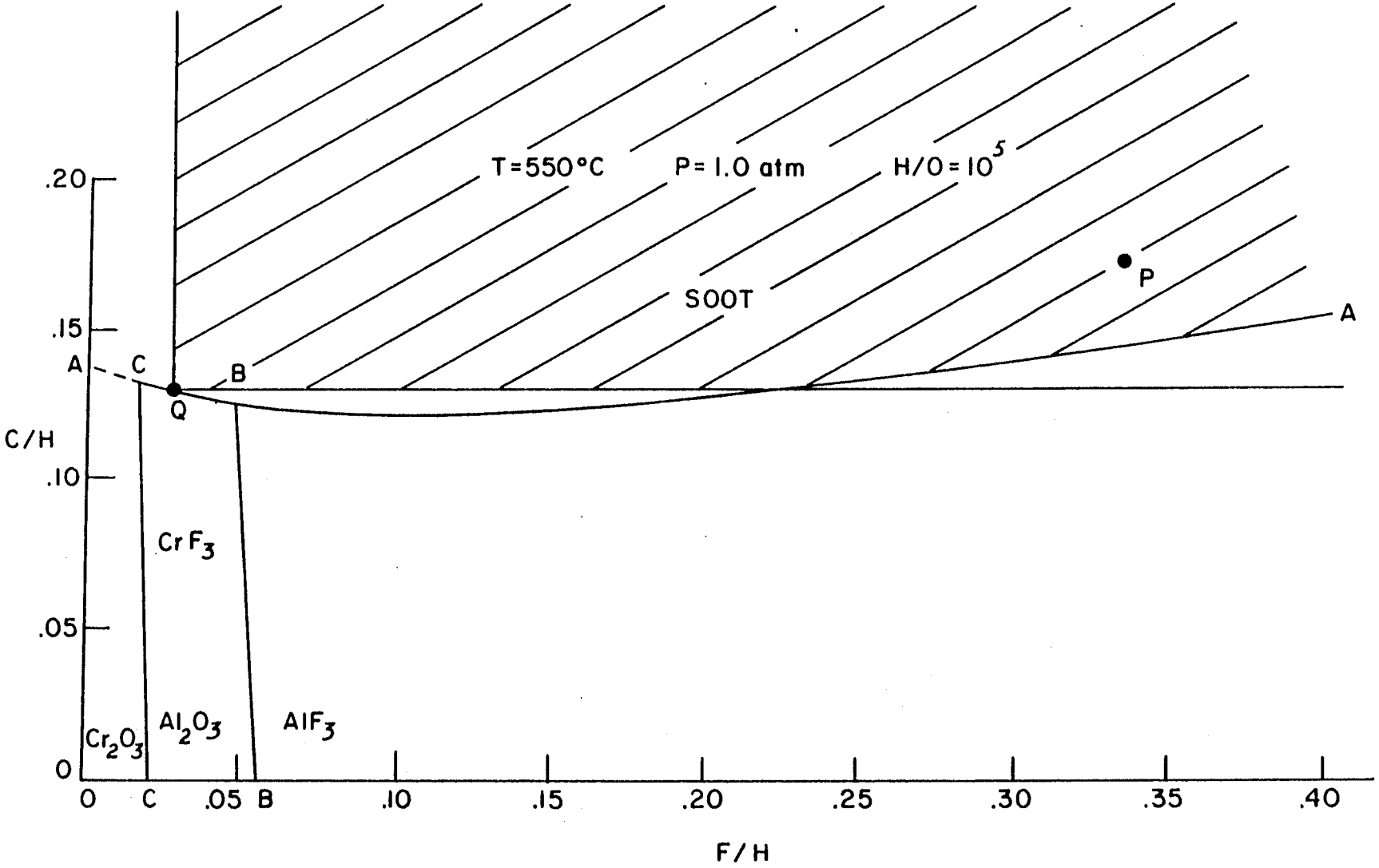
A
P
H/O=10^5
P=1.0 atm
T=550°C
SOOT
B
Q
C
A
CrF3
AlF3
Al2O3
Cr2O3
.20
.15
.10
.05
0
C/H
0
C
.05
B
.10
.15
.20
.25
.30
.35
.40
F/H

PROCESS FOR REMOVING PROTECTIVE COATINGS AND BONDING LAYERS FROM METAL PARTS

This is a continuation of application Ser. No. 135,536, filed Dec. 18, 1987, which is a continuation of application Ser. No. 06/826,718 filed Feb. 6, 1986, now both abandoned.

BACKGROUND OF THE INVENTION

The present invention relates to a process for removing protective coatings and/or bonding layers from a base metal, and more particularly, to a process for removing gamma prime bonding layers, intermetallic protective coatings, and metallic protective coatings from a part such as a gas turbine engine component part.

Protective coatings and bonding layers are widely used in modern gas turbine engines. The use of such protective coatings and bonding layers permits a designer to specify structural materials of high strength without having to be particularly concerned with the surface stability of the materials. Intermetallic coatings, and metallic coatings in particular are used on metal parts which encounter severe operating conditions at elevated temperatures. Such parts include gas turbine parts such as, the burner assembly, turbine vanes, and blades. Bonding layers are used to achieve a good bond between a base metal and a protective coating between which an adequate bond might not otherwise be obtained.

Various situations exist in which these protective coatings and/or bonding layers need to be removed. One such situation is when a part is crack damaged; the coating needs to be removed so that the part may be cleaned, repaired, recoated, and returned to service. Another situation arises upon improper application of the original coating; the coating needs to be removed so that a new coating may be applied. A third situation arises as the coating becomes worn while in service. The coating must be removed and a new coat applied.

Currently, these coatings are removed by the use of acid baths. U.S. Pat. No. 3,948,687 discloses an aqueous $HF-HNO_3$ stripping bath in which $CrO_3$ is also present for removing aluminized cases. The stripping bath operates at 85° F. The aluminized case dissolves in the bath and the base metal is not significantly attacked.

Additionally, U.S. Pat. No. 4,176,433 discloses a more detailed process for chemically stripping an aluminide protective coating from the internal and external surfaces of a salvageable vane. The part is grit-blasted and then immersed in an agitated nitric acid solution at 75° to 90° F. for four hours. The part is then wet abrasive-blasted and immersed in an agitated nitric acid solution at 75° to 90° F. for four hours. The wet abrasive-blasting and immersion in acid are repeated until the coating is removed.

Fluorocarbon cleaning of crack damaged metal parts is known in the art. U.S. Pat. Nos. 4,188,237; 4,324,594; 4,328,044; and 4,405,379 disclose processes for cleaning crack damaged stainless steel, superalloy, solid solution superalloy, and gamma prime hardened nickel alloy parts which render the parts braze repairable. The preferred cleaning process involves a three-stage procedure to eliminate the passivating oxides from the metallic surface. In stage I, a cleaning atmosphere of carbon, oxygen, hydrogen, and fluorine between 450°-800° C., converts noble oxides on the metallic surface and in the cracks to their fluorides. During stage II, the atmosphere is maintained to draw Al and Ti from the surface by diffusion. In stage III, a predominantly hydrogen atmosphere between 750° and 1000° C., converts the crystalline non-volatile fluorides to their conjugate metals. This fluorocarbon cleaning process avoids operation within the sooting range, i.e., the point at which carbon precipitates from the gas phase at the temperature, pressure, and H/O ratio of the treating atmosphere. If operated in the sooting range, the cracks, which are rich in nucleation sites, gather soot and cannot be cleaned.

While the aforementioned fluorocarbon cleaning process eliminates passivating oxides from a metallic surface, the fluorination potential of the process is lower than is required to significantly remove protective coatings, bonding layers, and the like which are common on gas turbine engine component parts. The current and prevailing acid bath procedure for removing aluminide-type coatings is undesirable because the procedure is expensive, lengthy, somewhat dangerous, and produces large volumes of hazardous waste. Thus, a clear need exists for an efficient, safe, and clean method for removing aluminide-type coatings from gas turbine engine component parts.

SUMMARY OF THE INVENTION

The present invention provides a process for removing gamma prime bonding layers, intermetallic coatings, and metallic coatings from a base metal such as a solid solution superalloy, a gamma prime hardened nickel base alloy, or a cobalt base or iron base superalloy. Removal is accomplished by subjecting the part to an atmosphere containing carbon, oxygen, hydrogen, and fluorine (C—O—H—F). When using such a gaseous atmosphere under controlled conditions, as described below, it is possible to adequately remove protective coatings and/or bonding layers from a base metal. Compared to the commonly employed method of removing protective coatings and/or bonding layers from metal parts by repeatedly grit-blasting and immersing the parts in nitric acid baths for several hours, the ecological advantages and safety of the process of the present invention are readily apparent. Furthermore, many of these coatings cannot be adequately removed in an acid bath.

A key to this coating removal process is control of the C/H and F/H atomic ratios in the C—O—H—F gaseous atmosphere. Thus, at a C/H ratio of greater than or equal to 0.125 and a F/H ratio of greater than or equal to 0.025, the protective coatings and/or bonding layers on a base metal can be adequately removed at temperatures of 500° to 900° C. As in the cleaning processes, the H/O ratio also must be greater than $10^4$ to generate a very low oxygen potential atmosphere. The H/O ratio of $10^4$ corresponds to approximately 200 ppm $H_2O$ present as moisture in the hydrogen gas used as a component of the C—O—H—F atmosphere.

In accordance with the preferred embodiments of the invention, the stripping atmosphere is generated by pyrolysis of a fluorocarbon resin. As disclosed in U.S. Pat. No. 4,188,237, polytetrafluoroethylene resin liberates its monomer when heated to 350° C. or higher, and the rate of evolution sharply increases between 450° and 500° C.

Liberation of the monomer is only a part of the decomposition process. When reduced to its simplest yet feasible form, the system contains only fluorocarbons, and then, only tetrafluoroethylene ($C_2F_4$) needs to be considered. Upon introduction of $H_2$ into the system, two sets of reactions occur. $C_2F_4$ gas reacts with the $H_2$ gas to produce HF gas and carbon. The HF then reacts with the Al in the protective coating to produce $AlF_3$ and $H_2$. Likewise, the HF reacts with the Cr in the protective coating to produce $CrF_3$ and $H_2$. Additionally, $C_2F_4$ reacts directly with the Al and Cr in the protective coating to produce $AlF_3$, $CrF_3$ and carbon. The volatile fluorides, $AlF_3$, sublime from the protective coating. The reactions are as follows:

$$C_2F_4 + 2H_2 \longrightarrow 4HF + 2C$$

$$3HF + Al \longrightarrow AlF_3 + 3/2H_2$$

$$3HF + Cr \longrightarrow CrF_3 + 3/2H_2$$

$$3C_2F_4 + 4Al \longrightarrow 4AlF_3 + 6C$$

$$3C_2F_4 + 4Cr \longrightarrow 4CrF_3 + 6C$$

It is also believed that $C_2F_4$, when mixed with moist hydrogen, reduces the water content by the reaction:

$$C_2F_4 + 2H_2O \rightarrow 4HF + 2CO$$

Thus, the decomposed fluorocarbon resin gases are not only moisture-free, but also react with the moisture otherwise introduced to, overall, create an extremely high fluoridizing atmosphere. It has been found that this atmosphere is capable of undermining most of the protective coatings and/or bonding layers used on a base metal.

The primary objective of the process is to remove the protective coatings and/or bonding layers from the metallic surface; however, if continued, the process can be used to deplete all surfaces, including the surfaces of any cracks or crevices, of Al and Ti to produce a surface that can be wet by brazing alloys.

The protective coatings and/or bonding layers are undermined in the process by converting metallic elements such as Al and Cr in the coatings or bonding layers to their fluorides, $AlF_3$ and $CrF_3$. The volatile fluorides, $AlF_3$, sublime from the protective coatings and/or bonding layers thereby rendering the coating or layer readily removable by grit-blasting. If the process is allowed to continue, i.e., if diffusion is allowed to continue after the coating has been undermined, Al and Ti are drawn from all surfaces of the base metal and converted to their fluorides. Volatile fluorides, such as $AlF_3$, are allowed to sublime from the metallic surface; the non-volatile fluorides, $CrF_3$ are, at a later stage, reduced to their conjugate metals.

The fluoridizing potential of the stripping process of the present invention results in effective removal of protective coatings and/or bonding layers from metallic surfaces. To achieve the high fluoridizing potential which is required, the process operates within the sooting range, i.e., conditions under which carbon precipitates from the stripping atmosphere. After stripping within the sooting range, the process of the present invention introduces $CO_2$ into the system. The $CO_2$ removes any soot deposited on the parts and in the system.

The invention provides a process for removing protective coatings and/or bonding layers from a base metal which comprises:

providing an atmosphere containing the elements C, O, H, and F in which the C/H ratio is greater than or equal to 0.125, the F/H ratio is greater than or equal to 0.025, and the H/O ratio is $10^4$ or greater;

subjecting said base metal to said atmosphere at a temperature of about 500° to 900° C. for a period of time sufficient to undermine said coating or bonding layer;

replacing said atmosphere with $CO_2$;

subjecting said base metal to said $CO_2$ for a period of time sufficient to remove any carbon deposited on said base metal and in the system while subjecting said base metal to said atmosphere containing C, O, H, and F without oxidizing said base metal; and removing said undermined coating or bonding layer from said base metal.

Another, more specific object of the present invention is to provide a process for removing protective coatings and/or bonding layers from a base metal such as a solid solution superalloy, a gamma prime hardened nickel base alloy, and a cobalt base or a iron base superalloy part through the use of a C—O—H—F gaseous atmosphere.

Another object of the present invention is to provide a process for removing gamma prime bonding layers, intermetallic protective coatings, and metallic protective coatings from a base metal and depleting the surfaces of the base metals of Al and Ti so that the base metals are rendered braze repairable.

Other objects and advantages of the present invention will be apparent from the following description and the appended claims.

BRIEF DESCRIPTION OF THE DRAWINGS

The FIGURE is a phase stability diagram for a Cr—Al—C—O—H—F system at 1.0 atm. pressure, $H/O = 10^5$ and $T = 550°$ C.

DETAILED DESCRIPTION OF THE INVENTION

The present invention is useful in removing protective coatings and/or bonding layers from a base metal. Protective coatings removable by the process of the present invention include intermetallic coatings and metallic coatings. Examples of intermetallic coatings include aluminide coatings, chromium coatings, chromium-aluminide coatings, and nickel-aluminide coatings. An example of a metallic coating is a chromium-aluminum coating.

The present invention is also useful in removing any bonding layer which may be interposed between the protective coating and the base metal. Examples of bonding layers removable by this process include gamma prime bonding layers, and metal-chromium-aluminum-yttrium layers.

The coatings and bonding removed by this process typically contain chromium or aluminum and, in addition, may contain elements such as cobalt, yttrium, and iron. These coatings are highly oxidation-and corrosion-resistant. In general, where present, the chromium content is at least 10% while the aluminum content is at least 5.0%.

Frequently, the present invention will be discussed with reference to the reaction of chromium or aluminum in the coatings since typically these metals are the most difficult to remove. Thus, in generating chromium and aluminum fluorides, one concomitantly generates the fluorides of more reactive and more easily removable metals in the coating. Thus, while the discussion refers to removing chromium and aluminum, it is also applicable to the removal of coatings containing large proportions of zirconium, nickel, cobalt, and iron.

The stripping process of the present invention can be used to remove coatings and/or bonding layers from a wide variety of base metals, including but not limited to solid solution superalloys, gamma prime hardened nickel base alloys, and cobalt or iron base superalloys. At present, a partial list of nickel-based, gamma prime hardened alloys includes INCO 713C, Mar M-200, Rene 80, Rene 95, Rene 100, Rene 41, Udimet 500, and Udimet 520. These range from low, i.e., Rene 41, to medium, i.e., INCO 713C, to high, i.e., Rene 100, levels of gamma prime hardening. All levels may be stripped by the process of the present invention. While the present invention is not limited to cleaning any particular metal part, representative parts include variations of a turbine disc, blade, or segments from a nozzle guide vane.

In the process of the present invention, a C—O—H—F cleaning atmosphere is established which diffuses into the coating and/or bonding layer, and converts the metals (typically Al and Cr) in the coatings or bonding layers to their fluorides. The cleaning atmosphere is most readily produced by pyrolyzing a fluorocarbon resin. A preferred fluorocarbon resin is polytetrafluoroethylene (PTFE).

In most cases, the stripping process is carried out in a sealed reaction chamber. Since the chamber is sealed, it is necessary to place a sufficient quantity of the fluorine source in the chamber to react with the fluoridizable materials in the coating or bonding layer, and if the process is used to deplete surfaces of Al and Ti, to react with these elements as well. A tandem chamber arrangement is also useful wherein the fluorine source is placed in one chamber where it is pyrolyzed and from which it is fed to a second chamber in which the stripping takes place.

The process of the present invention is carried out over a temperature range of about 500° to 1000° C. and for a reactive time of about 4 hours. The process can be considered in stages.

The reactor is heated to pyrolyze the fluorocarbon source. During the initial stage of the process, the rate of pyrolysis of the fluorocarbon is controlled to contain the fluoridizing chemicals until they can react. A slow diffusion rate is accommodated via this control and the load is thereby held in a high fluoridizing potential atmosphere up to 12 hours. If the fluorocarbon is pyrolyzed too rapidly, the fluoridizing constituents will be exhausted from the cleaning atmosphere without reacting with the coating or base metal, and the reactor atmosphere may not contain sufficient fluorine constituents to undermine the coating or bonding layer.

The fluorine concentration of the atmosphere can be calculated based on the preloaded mass of the fluorocarbon resin, the pyrolysis rate of the fluorocarbon, and the pyrolysis time. Upon reaching 510° C., the PTFE pyrolyzes at a rate of 0.021 g/g remaining/min. Based on the fluorine concentration, $H_2$ is then added to the atmosphere to achieve a C/H ratio of greater than or equal to 0.17, and a F/H ratio of greater than or equal to 0.33. Using PTFE, the C/F ratio is 0.5. The C/H and F/H ratios may be decreased dramatically as temperatures rise while maintaining sooting conditions in the atmosphere.

The pyrolysis of PTFE ends at 550° to 620° C. When it is clear that the required high fluoridizing potential is achieved within the reactor, the reactor is carried to the second stage of the process where the temperature of the system is increased to about 800° C. At this higher temperature, the diffusion rate of the fluorine into the coating increases. The atmosphere is maintained in the temperature range of 700° to 1000° C. for a period of time sufficient to undermine the protective coatings or bonding layers. These protective coatings are about 1 to 5 mils in thickness and require about 4 hours to undermine.

After the atmosphere has reacted with the metals in the coatings or bonding layers, if desirable, the atmosphere may be maintained to react with the aluminum and titanium on the metallic surfaces of the base metal for conversion to their fluorides, $AlF_3$ and $TiF_x$, in accordance with stage II of the cleaning process described in U.S. Pat. No. 4,405,379. These reactions deplete the metallic surfaces of Al and Ti, and prevent the oxides of these elements from re-forming upon exposure to air. During this, as well as previous stages, chromium fluoride ($CrF_3$) also and unavoidably forms. Because of its refractory nature, the $CrF_3$ remains in the reaction chamber and must be reduced to its metallic form. This reduction step, however, must await the soot removal step.

Because the atmosphere has been held in the high fluoridizing range during the stripping and depletion stages, carbon in the form of soot is in the reaction chamber, and in cracks and passages of the part. This soot is removed by introducing carbon dioxide ($CO_2$) into the chamber while holding at a high temperature. This step clears the soot by the following reaction:

$$CO_2 + C_{gr} \rightarrow 2CO$$

The amount of $CO_2$ that is required to purge the soot is determined by first assuming that all fluorocarbon has formed soot and then assuming thermodynamic equilibrium in the C—CO—$CO_2$ system. When all of the soot has been oxidized and driven off in the form of CO, the final stage is entered.

In the final stage, the $CrF_3$ that has unavoidably formed is rendered metallic by reduction to its corresponding elemental form as the invention atmosphere is caused to become rich in hydrogen analogous to stage III of U.S. Pat. No. 4,405,379. This reaction is performed at temperatures in excess of 750° C. and most typically at temperatures ranging from about 900° to 1,000° C.

The undermined coating is removed. A preferred removal process is grit-blasting.

The invention process may be demonstrated graphically. Thus, the phase stability diagram of the Figure reveals atmospheres at which aluminum and chromium are converted to their fluorides at 550° C. The pressure is fixed at 1.0 atmosphere and the H/O ratio is set at $10^5$. The phase fields are shown imposed on an abscissa which is the F/H ratio and the ordinate which is the C/H ratio. Al and Cr are representative of the elements found in the protective coatings on gas turbine engine parts. Therefore, a Cr—Al—C—O—H—F system is used to illustrate the invention.

In the Figure, curve A represents the sooting line, i.e., the point at which carbon can precipitate from the gas phase at the temperature, pressure, and H/O ratio of the treating atmosphere. Sooting is promoted in the present invention in order to obtain a high fluoridizing potential.

Curve B in the Figure is the equilibrium line for a $Al_2O_3$ (solid)-$AlF_3$(gas) system under the system conditions described above. Below and to the left of curve B, a metal part may have $Al_2O_3$ and similar metal oxides on its surface. In this condition, the part cannot be brazed. Above and to the right of curve B, these oxides are converted to fluorides and removed from the metal surface.

Curve C on the phase stability diagram separates the oxide ($Cr_2O_3$) and its fluoride ($CrF_3$). $Cr_2O_3$ is present below and to the left of curve C.

The process of the present invention operates within the hashed region indicated in the Figure. At point Q, the C/H ratio is equal to 0.125 while the F/H ratio is equal to 0.025. Those skilled in the art will appreciate that comparable phase stability diagrams with the corresponding hashed operational region exist for the full temperature range, i.e., 500° to 1000° C., of the process of the present invention. Thus, in one embodiment of the present invention, through temperature control and management of the C/H and F/H ratios, the Al and the Cr in the protective coatings are converted to their fluorides, $AlF_3$ and $CrF_3$. Those skilled in the art will also understand that in another embodiment of the invention process, the Al and Cr on the metallic surface convert to their fluorides. Additionally, those skilled in the art will understand that in a further embodiment of the present invention, through temperature control and management of the C/H and F/H ratios, the $CrF_3$ is reduced to Cr.

Where the C—O—H—F atmosphere is derived from PTFE, the C/F ratio in the retort is approximately 0.5; a 1:2 ratio of carbon to fluorine atoms is present in the resin. At the same time, atmospheres having C/F ratios equal to 0.5 can be derived from difluoroethylene and mixtures of tetrafluoromethane and hydrogen among others.

Where certain minimum amounts of carbon, fluorine, and hydrogen are not present, the process of the present invention may take an inconvenient amount of time. Point Q on the Figure signifies a gas composition that is potentially achievable by the preferred embodiment of PTFE and $H_2$, and represents an atmosphere which is consonant with the stripping process and reasonable speed. Point Q represents the C and F levels about as low as a practitioner may go to efficiently remove protective coatings and/or bonding layers from gas turbine engine parts. Thus, typically the invention process is performed at a F/H ratio greater than or equal to 0.33, and a C/H ratio greater than or equal to 0.17. Point P represents the typical process levels.

Upon removal of the protective coatings and/or bonding layers, depletion of the Al and Ti, and destabilization of the $CrF_3$, the metallic parts are braze repairable. A successful braze is manifest when braze material is placed at the source of a crack (say 0.001 inch wide and ½ inch long) and, at brazing temperature, not only melts and sticks to the parent material, but also runs into and fills the length of the crack. The parts may also be otherwise bonded by carefully performed welding techniques.

The most expedient source of the stripping atmosphere is a fluorocarbon resin such as polytetrafluoroethylene which releases fluorine-containing species upon thermal decomposition. Other fluorocarbon resins which release gaseous fluorine species upon thermal decomposition may also be used. Decomposed fluorocarbon resin gases are a convenient source of the stripping atmosphere because they are not only moisture-free, but, as indicated above, they also react with moisture otherwise introduced to create an extremely reducing atmosphere.

In addition to PTFE, other sources of the C—O—H—F stripping atmosphere exist. The invention atmosphere can, for example, be generated by reacting hydrogen with any saturated or unsaturated fluorocarbon such as and including difluoromethane ($CH_2F_2$), tetrafluoromethane ($CF_4$), tetrafluoroethylene ($C_2F_4$), and many of the freons. In addition, the stripping atmosphere may be generated from a mixture of HF, $CH_4$, and $H_2$. Substantially, any fluorocarbon resin which can be pyrolyzed may be used in the process of the present invention.

The process of the present invention is typically performed at atmospheric pressure. The inherent advantages of using an increased pressure system are readily apparent. Increased pressure would undoubtedly cause pyrolysis of the resins to occur at higher temperatures where their chemical effects would be more pronounced.

In a less preferred embodiment, aqueous stripping may be used in conjunction with the process of the present invention. After subjecting a part to the instant process and grit-blasting, the part would be aqueous stripped. Aqueous stripping usually involves immersing a part in agitated nitric acid at 75° to 90° F. Aqueous stripping is undesirable because the procedure is somewhat dangerous and produces large volumes of hazardous waste. Also, the use of aqueous solutions tends to result in inner granular attack of the base metal.

The present invention is more fully illustrated by the following non-limiting Examples.

EXAMPLE I

HPI turbine blades from the Allison TF-41 engine are cast from Mar M 246 alloy and coated with Alpak. These, when removed from an engine in a service damaged condition, were placed in a vertical reaction chamber which contained teflon that had been placed on the bottom. The chamber was closed and, while being heated, hydrogen was introduced to impinge on the teflon, rise across the load, and exit at the top. The chamber was heated to 580° C., and the hydrogen turned off while the chamber continued to heat to 800° C. The system was held at 800° C. for 1 hour to allow the stripping gases to undermine the coatings. Carbon dioxide was then introduced to purge the soot while the chamber was heated to 950° C. where hydrogen was again introduced to reduce the non-volatile fluorides to their conjugate metals.

After cooling, the parts were grit-blasted to remove the undermined coating. The parts were then immersed in a nitric acid solution for 5 to 15 minutes in order to remove the chromium particles entrapped in the cleaned but porous base metal surface. After rinsing and drying, the parts were vacuum brightened at 1100° C. for ½ hour. The stripped and cleaned blades were readily brazed or welded.

EXAMPLE II

Pieces of Nimonic Alloy 75 from a flame tube of a Rolls Royce Nene engine of the Canadian Air Force T-33 Trainer have one side partially coated with a mixture of Nichrome and Chromium carbide. The opposite side has a bond coating of Metco 443 (a NiCrAlY) and an overlay coating of yttria stabilized zirconia. The zirconia was removed by grit-blasting to reveal the NiCrAlY bond coating, and the bare base metal of the opposite side was masked by a plasma sprayed coating of silicon carbide. The resulting part was placed in a reaction chamber with teflon and the chamber was sealed. The chamber was heated to 450° C., hydrogen was introduced and caused to flow until the chamber reached 580° C. where the hydrogen was turned off while the chamber was heated to 800° C. The system was held at 800° C. for 1 hour to allow the stripping gases to undermine the coating. Carbon dioxide was introduced to purge the soot, and the chamber was heated to 950° C. where hydrogen was again introduced to reduce the non-volatile fluorides to their conjugate metals.

After cooling, the part was grit-blasted and immersed in stripper solution for 15 minutes. The part was removed, grit-blasted, and vacuum brightened at 1100° C. for ½ hour. The base metal was readily brazed or welded.

Having described the invention in detail and by reference to preferred embodiments thereof, it will be apparent that modifications and variations are possible without departing from the scope of the invention defined in the appended claims.

What is claimed is:

1. A process for stripping metallic or intermetallic protective coatings and/or bonding layers from about 1 to 5 mils in thickness from a base metal which comprises:

a) providing an atmosphere containing the elements C, O, H, and F, said atmosphere being operated within the sooting range thereof to achieve a high enough fluorination potential to undermine a metallic or intermetallic protective coating and/or bonding layer having a thickness from about 1 to 5 mils from said base metal by maintaining a C/H ratio of 0.17 or greater, a F/H ratio of 0.33 or greater, and a H/O ratio of $10^4$ or greater;

b) subjecting said base metal to said atmosphere at a temperature of about 500° to 900° C. for about 4 hours to undermine said protective coating;

c) replacing said atmosphere with $CO_2$;

d) subjecting said base metal to said $CO_2$ for a period of time sufficient to remove any carbon deposited on said base metal while said base metal was subjected to said atmosphere operated within said sooting range thereof; and e) removing said undermined protective coating or bonding layer from said base metal.

2. The process of claim 1 wherein said step of providing said atmosphere containing C, O, H, and F comprises pyrolyzing a fluorocarbon.

3. The process of claim 2 wherein said fluorocarbon is polytetrafluoroethylene.

4. The process of claim 1 wherein said undermined coating or bonding layer is removed by grit-blasting.

5. The process of claim 3 wherein said base metal is subjected to said atmosphere at a temperature of about 500° to 600° C. until such time as said polytetrafluoroethylene is fully pyrolyzed, whereafter, said base metal is subjected to said atmosphere at about 700° to 800° C. until said coating or bonding layer is removable by grit-blasting.

6. The process of claim 1 wherein after subjecting said base metal to $CO_2$, said process comprises the additional step of subjecting said base metal to an atmosphere consisting essentially of hydrogen to reduce any $CrF_3$ on the surface of said base metal to Cr.

7. The process of claim 6 wherein said base metal is subjected to said atmosphere consisting essentially of hydrogen at a temperature of about 900° to 1000° C.

8. The process of claim 1 wherein pressure is atmospheric.

9. The process of claim 1 wherein said base metal is a material selected from the group consisting of solid solution superalloys, gamma prime hardened nickel base alloys, cobalt base superalloys, and iron base superalloys.

10. The process of claim 1 wherein said protective coating is an aluminide, a chromium-aluminide or a nickel-aluminide coating.

11. The process of claim 1 wherein said coating is a chromium-aluminum coating.

12. The process of claim 1 wherein said bonding layer is a gamma prime bonding layer, or a chromium-aluminum-yttrium layer.

13. A process for stripping metallic or intermetallic protective coatings and/or bonding layers from about 1 to 5 mils in thickness from a base metal which comprises:

a) providing an atmosphere containing the elements C, O, H, and F by pyrolyzing a polytetrafluoroethylene resin, said atmosphere being operated within the sooting range thereof to achieve a high enough fluorination potential to undermine a metallic or intermetallic protective coating and/or bonding layer having a thickness of from about 1 to 5 mils from said base metal by maintaining a C/H ratio of 0.17 or greater, a F/H ratio of 0.33 or greater, and a H/O ratio of $10^4$ or greater;

b) subjecting said base metal to said atmosphere at a temperature of about 500° to 900° C. for about 4 hours to undermine said protective coating or bonding layer;

c) replacing said atmosphere with $CO_2$;

d) subjecting said base metal to said $CO_2$ for a period of time sufficient to remove any carbon deposited on said base metal while said base metal was subjected to said atmosphere operated within said sooting range thereof; and e) removing said undermined protective coating or bonding layer from said base metal.

14. The process of claim 13 wherein said base metal is subjected to said atmosphere at a temperature of about 500° to 600° C. until such time as said polytetrafluoroethylene is fully pyrolyzed, whereafter, said base metal is subjected to said atmosphere at about 700° to 800° C. until said coating is removable by grit-blasting.

15. The process of claim 14 wherein after subjecting said base metal to $CO_2$, said process comprises the additional step of subjecting said base metal to an atmosphere consisting essentially of hydrogen to reduce any $CrF_3$ on the surface of said base metal to Cr.

16. The process of claim 15 wherein said base metal is subjected to said atmosphere consisting essentially of hydrogen at a temperature of about 900° to 1000° C.

* * * * *